US011933110B2

(12) United States Patent
Van Belkom et al.

(10) Patent No.: US 11,933,110 B2
(45) Date of Patent: Mar. 19, 2024

(54) SUPPRESSION ELEMENT FOR VORTEX VIBRATIONS

(71) Applicant: Lankhorst Engineered Products B.V., Sneek (NL)

(72) Inventors: Arnoldus Van Belkom, Sneek (NL); Karst Meijer, Sneek (NL)

(73) Assignee: Lankhorst Engineered Products B.V., Sneek (NL)

( * ) Notice: Subject to any disclaimer, the term of this patent is extended or adjusted under 35 U.S.C. 154(b) by 205 days.

(21) Appl. No.: 17/597,158

(22) PCT Filed: Jul. 3, 2020

(86) PCT No.: PCT/NL2020/050437

§ 371 (c)(1),
(2) Date: Dec. 28, 2021

(87) PCT Pub. No.: WO2021/002752

PCT Pub. Date: Jan. 7, 2021

(65) Prior Publication Data

US 2022/0307327 A1 Sep. 29, 2022

(30) Foreign Application Priority Data

Jul. 4, 2019 (NL) ..... 2023435

(51) Int. Cl.

| | |
|---|---|
| ***E21B 17/01*** | (2006.01) |
| ***B63B 39/00*** | (2006.01) |
| *B63B 21/50* | (2006.01) |

(52) U.S. Cl.

CPC ..... *E21B 17/01* (2013.01); *B63B 39/005* (2013.01); *B63B 2021/504* (2013.01)

(58) Field of Classification Search

CPC .. E21B 17/01; B63B 2021/504; B63B 39/005

See application file for complete search history.

(56) References Cited

U.S. PATENT DOCUMENTS

| | | | |
|---|---|---|---|
| 6,347,911 | B1 | 2/2002 | Blair et al. |
| 6,896,447 | B1 | 5/2005 | Taquino |

(Continued)

FOREIGN PATENT DOCUMENTS

| | | | |
|---|---|---|---|
| GB | 2335248 | A | 9/1999 |
| WO | 0068514 | A1 | 11/2000 |

(Continued)

OTHER PUBLICATIONS

International Search Report for corresponding International Application No. PCT/NL2020/050437 dated Oct. 2, 2020, 3 pages.

*Primary Examiner* — Kyle Armstrong
(74) *Attorney, Agent, or Firm* — Pearne & Gordon LLP

(57) ABSTRACT

By mutually interconnected specimens of a suppression element (100) according to the invention, there can be formed a strong and reliable construction of a tube around a tubular element. The suppression element (100) has a first fin structure (141) which is extending helically along a portion (121) of a first longitudinal edge (121, 131, 131 A, 131B), and a second fin structure (142) which is extending helically along a portion (122) of an opposite second longitudinal edge (122, 132, 132 A, 132B). In said tube, first fin structures and second fin structures of the various suppression elements are lying helically in-line relative to one another for effectively reducing vortex induced vibrations. The suppression elements (100, 200, 300, 400) are compactly stackable relative to one another.

8 Claims, 7 Drawing Sheets

(56) References Cited

U.S. PATENT DOCUMENTS

| | | | | |
|---|---|---|---|---|
| 8,770,894 | B1 | 7/2014 | Allen et al. | |
| 9,140,385 | B2 | 9/2015 | Meijer | |
| 10,774,949 | B2 * | 9/2020 | Esselbrugge | E02B 17/0017 |
| 2007/0196181 | A1 * | 8/2007 | Tyrer | F15D 1/10 248/49 |
| 2009/0185867 | A1 | 7/2009 | Masters et al. | |
| 2012/0291687 | A1 | 11/2012 | Dehne et al. | |
| 2013/0330131 | A1 * | 12/2013 | Meijer | F16L 1/26 405/184.2 |
| 2020/0141517 | A1 * | 5/2020 | Esselbrugge | F16L 1/123 |

FOREIGN PATENT DOCUMENTS

| | | | |
|---|---|---|---|
| WO | 2004020777 | A1 | 3/2004 |
| WO | 2005026560 | A1 | 3/2005 |
| WO | 2013140179 | A2 | 9/2013 |

* cited by examiner

L
500
100
512
512A
512B
541
541
531A
541
541
542
542
542
542
531B
511B
511A
511
112
112A
112B
141
141
141
141
132B
142
142
142
142
132A
111
111A
111B
C
R

SUPPRESSION ELEMENT FOR VORTEX VIBRATIONS

The invention relates to a suppression element for vortex vibrations, wherein:

the suppression element has a longitudinal direction, as well as a circumferential direction around a reference axis which is parallel to the longitudinal direction, and wherein the suppression element has an inner side and an opposite outer side, wherein the inner side has a concave shape in the circumferential direction and the outer side has a convex shape in the circumferential direction, and wherein the suppression element on both ends in the longitudinal direction has a first end edge and an opposite second end edge, and wherein the suppression element on both ends in the circumferential direction has a first longitudinal edge and an opposite second longitudinal edge;

the suppression element is configured for partly enveloping, in the circumferential direction, a tubular element, in such manner that the suppression element with the inner side is facing the tubular element for forming, in operation, a tube segment, which is extending co-axially round said reference axis, and which can co-axially envelope the tubular element all round as a result of a pre-determined number of at least two specimens of the suppression element being mutually interconnected in the circumferential direction, wherein the tube segment in the longitudinal direction has an overall length which is equal to the overall length of the suppression element in the longitudinal direction, and wherein said tube segment is configured for forming, in operation, a tube around the tubular element as a result of multiple specimens of said tube segment being mutually interconnected in the longitudinal direction; and the suppression element comprises a fin structure, which on said outer side is protruding at least in radial direction relative to said reference axis, and which is configured for reducing, in operation, vorticity shedding at the downstream side of the tubular element.

Such suppression elements for vortex vibrations are for example known in the offshore industry as so-called 'Vortex Induced Vibration strakes' or 'VIV strakes'. Such suppression elements are used on, for example, offshore drilling platforms to reduce the forces exerted by the water on a pipeline running from such a platform to an oil well or a so-called 'off-loading vessel'.

A suppression element of the type as initially indicated above is for example known from WO2004020777A1. In FIGS. 1-5 of WO2004020777A1 it is seen that the inner side and the outer side of the suppression element 1, including the inner side and the outer side of the fin structure 3, have corresponding shapes such that the suppression elements 1 are compactly stackable in a manner as shown in FIG. 5 of WO2004020777A1. This compact stackability of such suppression elements is very important, since, especially with transport in offshore applications, the volume is an important factor in the transportation costs of the suppression elements.

Another suppression element of the type as initially indicated above is for example known from U.S. Pat. No. 9,140,385B2. This other suppression element has another kind of fin structure than the fin structure known from WO2004020777A1. Nowadays, this other kind of fin structure is often used because of its favourable effects on reducing vortex induced vibrations. In FIGS. 1-2 of U.S. Pat. No. 9,140,385B2 it is seen that this other kind of fin structure consists of a series of multiple fins 7, of which the inner sides and the outer sides do not have corresponding shapes. Differently from the hollow, nestable fin structure 3 known from WO2004020777A1, U.S. Pat. No. 9,140,385B2 discloses solid, non-nestable fins 7. Due to this, the suppression elements known from U.S. Pat. No. 9,140,385B2 are not so compactly stackable as the suppression elements known from WO2004020777A1.

The elements known from WO2004020777A1 and the elements known from U.S. Pat. No. 9,140,385B2 have in common that in tubes, which have been formed with such elements, suppression elements of such a tube which are mutually adjacent in the longitudinal direction, are mutually positioned in a staggered manner in the circumferential direction. This is best seen in FIG. 4 of WO2004020777A1. Thanks to such a staggered positioning of suppression elements, the tubes being formed by them have a strong and reliable construction.

Furthermore, the elements known from WO2004020777A1 and the elements known from U.S. Pat. No. 9,140,385B2 have in common that, for tubes which have been formed with such elements, the helically extending fin structures of the suppression elements each time are lying helically in-line relative to one another. Also this is best seen in FIG. 4 of WO2004020777A1. Such fin structures, which are lying helically in-line relative to one another, are effective for reducing vorticity shedding.

It is an object of the invention to provide a solution according to which also suppression elements having a fin structure of which the inner sides and the outer sides do not have corresponding shapes (which occurs for example in case of solid, non-nestable fins) are compactly stackable, while preserving the possibility to form with such elements a tube, which is strong and reliable, and which effectively reduces vortex-induced vibrations.

For that purpose the invention provides a suppression element according to the appended independent claim 1. Specific embodiments of the invention are provided by the appended dependent claims 2-8.

Hence, the invention provides a suppression element for vortex vibrations, wherein:

the suppression element has a longitudinal direction, as well as a circumferential direction around a reference axis which is parallel to the longitudinal direction, and wherein the suppression element has an inner side and an opposite outer side, wherein the inner side has a concave shape in the circumferential direction and the outer side has a convex shape in the circumferential direction, and wherein the suppression element on both ends in the longitudinal direction has a first end edge and an opposite second end edge, and wherein the suppression element on both ends in the circumferential direction has a first longitudinal edge and an opposite second longitudinal edge;

the suppression element is configured for partly enveloping, in the circumferential direction, a tubular element, in such manner that the suppression element with the inner side is facing the tubular element for forming, in operation, a tube segment, which is extending co-axially round said reference axis, and which can co-axially envelope the tubular element all round as a result of a pre-determined number of at least two specimens of the suppression element being mutually interconnected in the circumferential direction, wherein the tube segment in the longitudinal direction has an overall length which is equal to the overall length of the suppression element in the longitudinal direction, and wherein said tube segment is configured for forming, in operation, a tube around the tubular element as a result of multiple specimens of said tube segment being mutually interconnected in the longitudinal direction; and the suppression element comprises a fin structure, which on said outer side is protruding at least in radial direction relative to said reference axis, and which is configured for reducing, in operation, vorticity shedding at the downstream side of the tubular element;

characterized in that the first longitudinal edge comprises at least one first fin longitudinal edge portion, wherein the at least one first fin longitudinal edge portion is extending helically around said reference axis;

the fin structure comprises a first fin structure, which is extending along the at least one first fin longitudinal edge portion, and which on said outer side at the at least one first fin longitudinal edge portion is protruding in said radial direction for said reducing of said vorticity shedding;

the second longitudinal edge comprises at least one second fin longitudinal edge portion, wherein the at least one second fin longitudinal edge portion is extending helically around said reference axis;

the fin structure comprises a second fin structure, which is extending along the at least one second fin longitudinal edge portion, and which on said outer side at the at least one second fin longitudinal edge portion is protruding in said radial direction for said reducing of said vorticity shedding; and the at least one first fin longitudinal edge portion and the at least one second fin longitudinal edge portion of the suppression element are configured such that, for each pair of, in the circumferential direction, mutually adjacent suppression elements of said tube segment, the at least one first fin longitudinal edge portion of one suppression element of said pair and the at least one second fin longitudinal edge portion of the other suppression element of said pair are lying helically in line relative to one another.

Hence, according to the invention the first fin structure and the second fin structure are extending along the first longitudinal edge and the second longitudinal edge, respectively. Furthermore, according to the invention the inner side and the outer side of the suppression element are shaped concavely and convexly, respectively, as seen in the circumferential direction. Thanks to the combination of the fin structures which thus are lying along the longitudinal edges, on the one hand, and said concave and convex forms of the inner side and the outer side of the suppression element, on the other hand, the suppression elements according to the invention are compactly stackable, and this also holds for suppression elements having a fin structure, of which the inner sides and the outer sides do not have corresponding shapes, which is for example the case for solid, non-nestable fins, such as the solid, non-nestable fins 7 in FIGS. 1-2 of U.S. Pat. No. 9,140,385B2.

In a preferable embodiment of a suppression element according to the invention:

the first longitudinal edge comprises at least one first non-fin longitudinal edge portion, along which said first fin structure is not extending;

the second longitudinal edge comprises at least one second non-fin longitudinal edge portion, along which said second fin structure is not extending;

the at least one first non-fin longitudinal edge portion and the at least one second non-fin longitudinal edge portion of the suppression element are configured such that, for each pair of, in the circumferential direction, mutually adjacent suppression elements of said tube segment, the at least one first non-fin longitudinal edge portion of one suppression element of said pair and the at least one second non-fin longitudinal edge portion of the other suppression element of said pair are mutually adjacent.

In another preferable embodiment of a suppression element according to the invention, the suppression element comprises a positioning structure, which is configured for positioning of suppression elements of said tube, said suppression elements being mutually adjacent in the longitudinal direction, in fixed mutually staggered positions in the circumferential direction, in such manner that, for each pair of, in the longitudinal direction, mutually adjacent tube segments of said tube, each time the at least one first fin longitudinal edge portions and the at least one second fin longitudinal edge portions of the suppression elements of one tube segment of said pair mutually are lying helically in line relative to first and second fin longitudinal edge portions of the other tube segment of said pair.

Thanks to such a positioning structure it is possible to precisely and reliable form tubes by suppression elements according to the invention, wherein the helically extending fin structures of the suppression elements each time are lying helically in-line relative to one another, which is effective for reducing vorticity shedding.

In the following, the invention is further elucidated with reference to a non-limiting embodiment and with reference to the schematic figures in the attached drawing, in which the following is shown.

Figure 1:
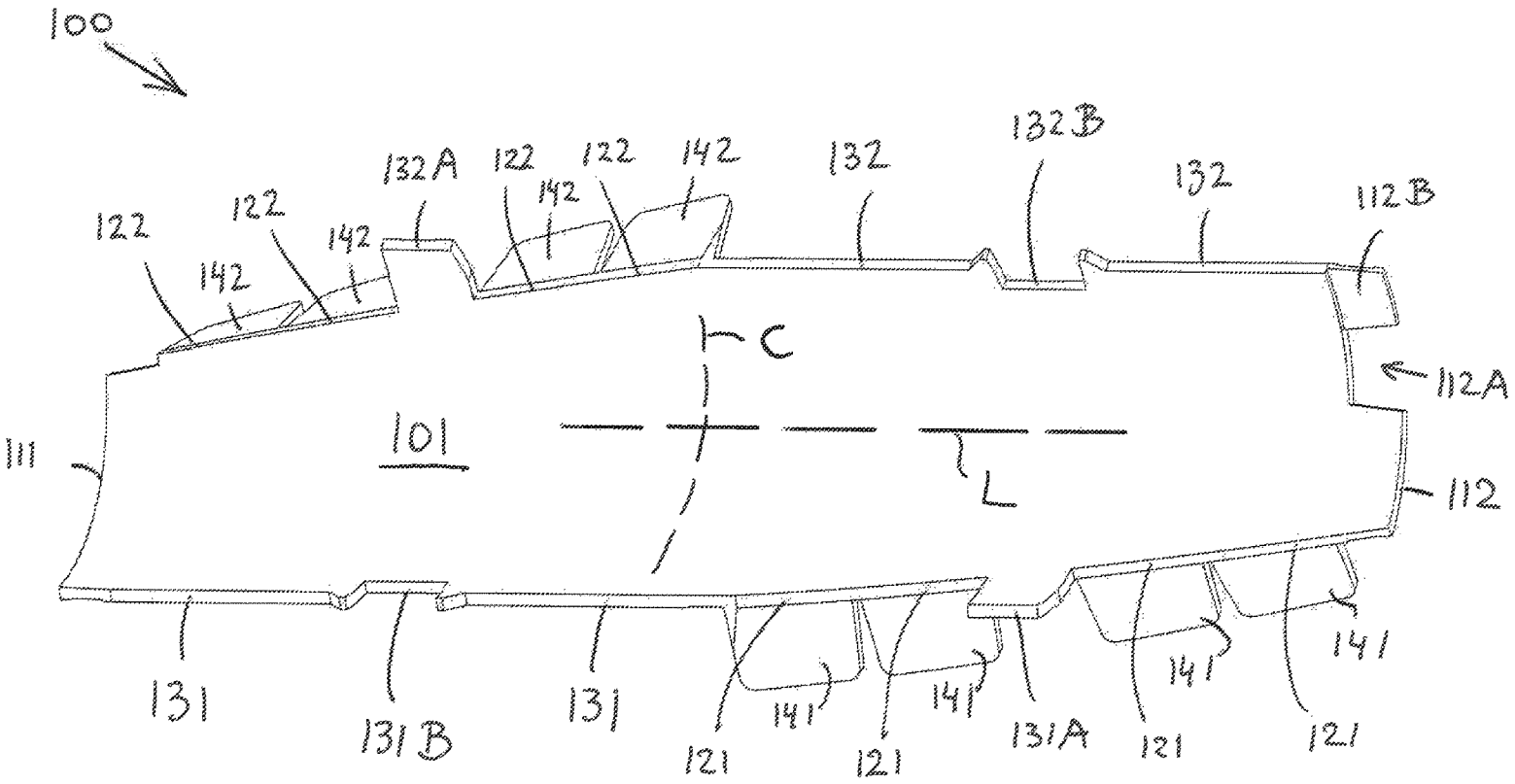
FIG. 1 shows a perspective view onto the inner side of an example of an embodiment of a suppression element according to the invention.
Figure 4:
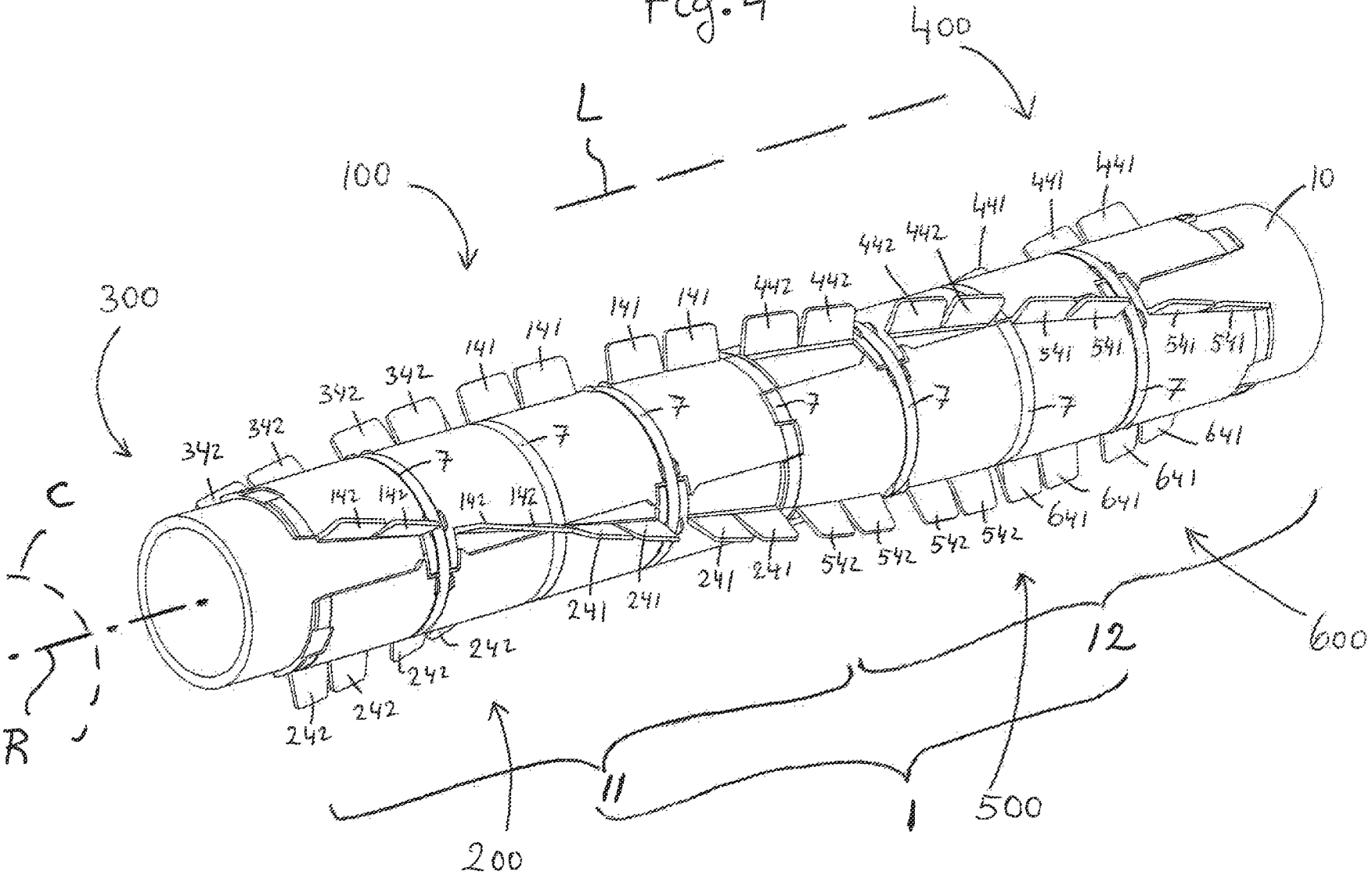

FIG. 4 shows a perspective view onto an assembly of a tubular element and a tube around the tubular element, wherein the tube is formed by mutually identical tube segments which are interconnected with one another in the longitudinal direction of the tubular element, and wherein each tube segment is formed by three suppression elements, each of which being identical to the suppression element of FIG. 1, and which in the circumferential direction of the tubular element are interconnected relative to one another.

Figure 5:
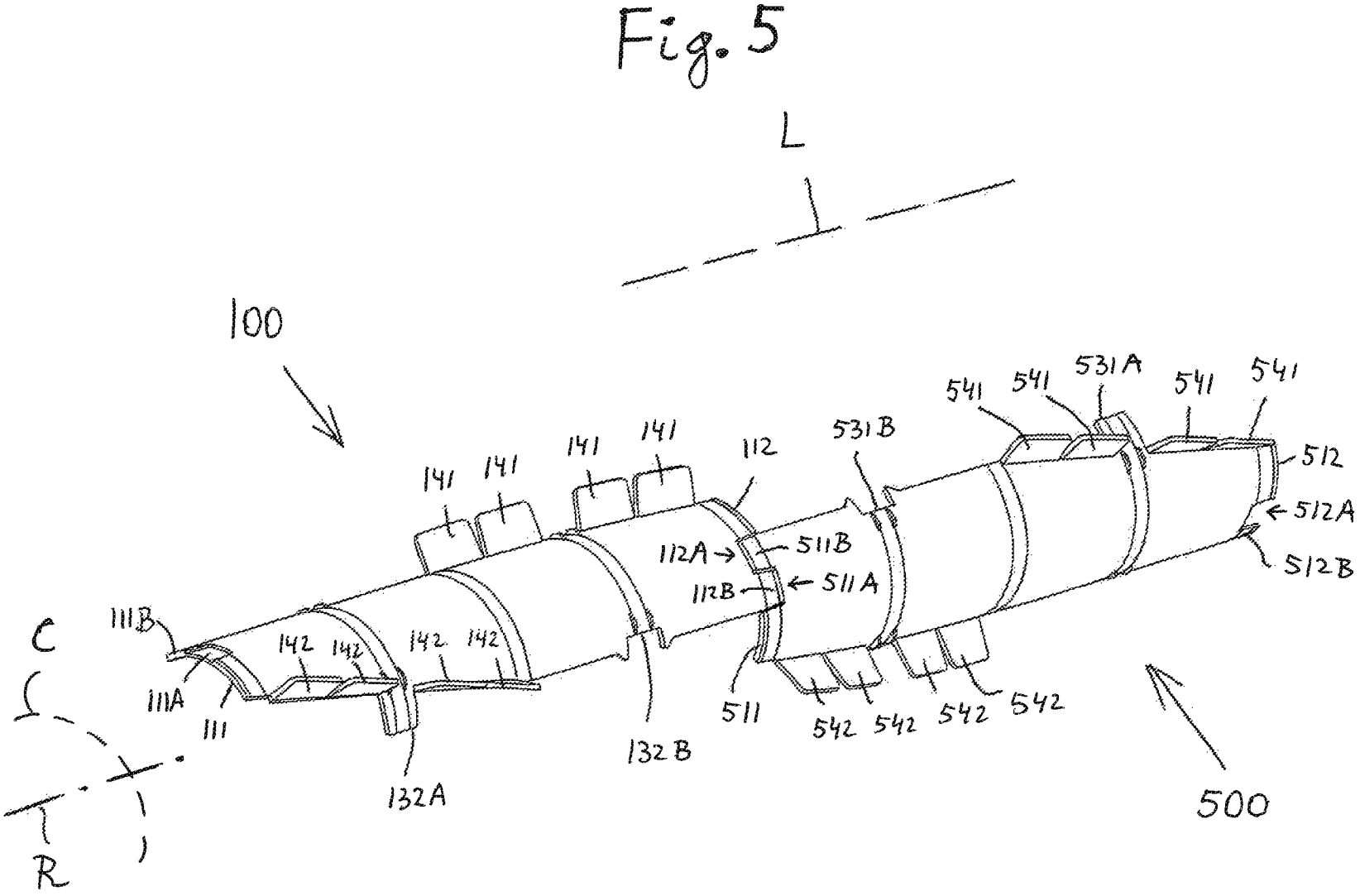

FIG. 5 separately shows suppression elements of the tube of FIG. 4, being mutually interconnected in the longitudinal direction, and in the same orientation and in the same perspective view as in FIG. 4.

Figure 6:
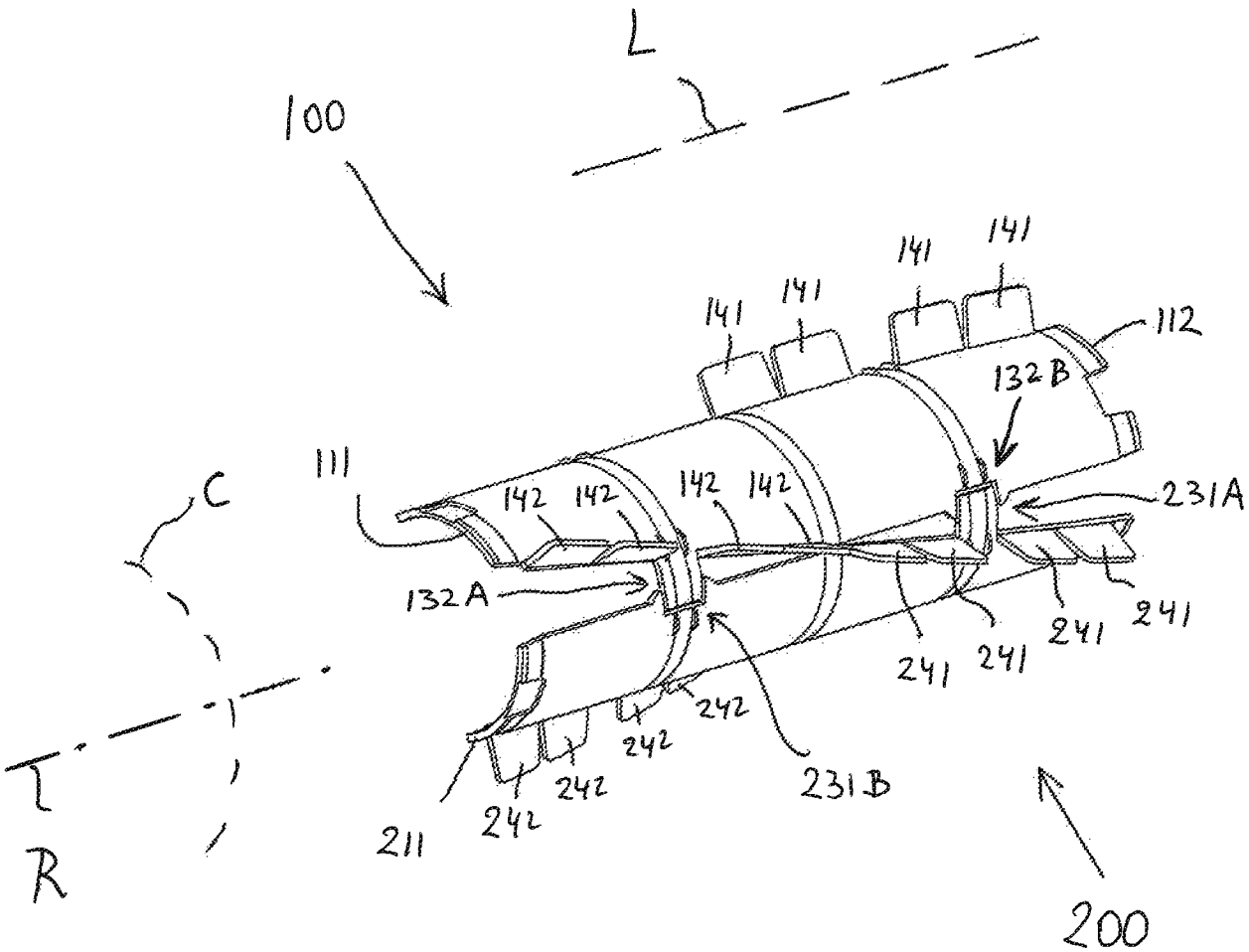

FIG. 6 separately shows suppression elements of the tube of FIG. 4, being mutually interconnected in the circumferential direction, and in the same orientation and in the same perspective view as in FIG. 4.

Figure 3:
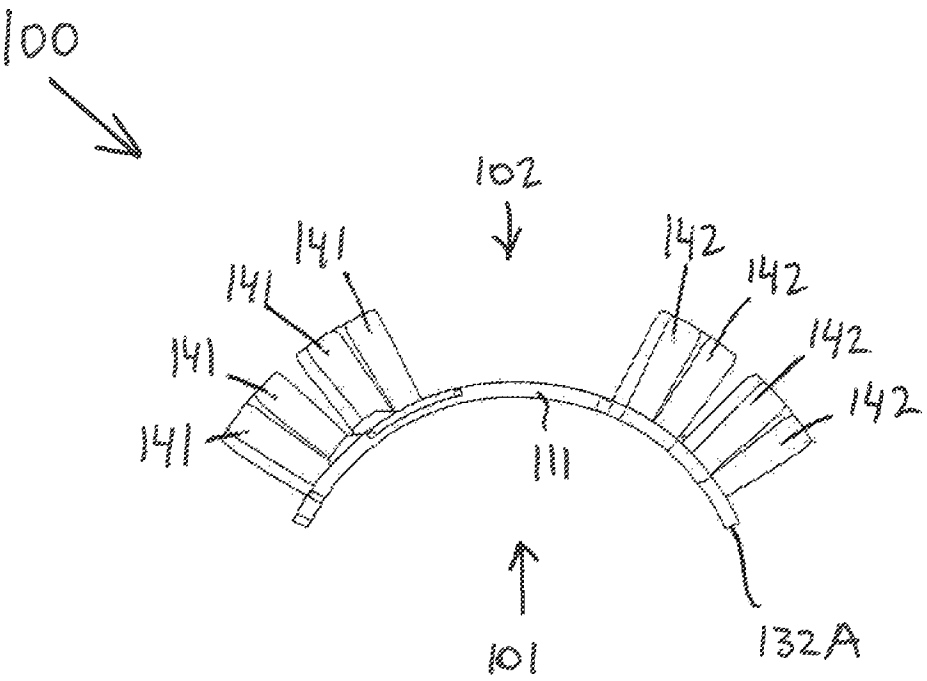
FIG. 3 shows a perspective view onto the first end edge of the suppression element of FIG. 1.
Figure 7:
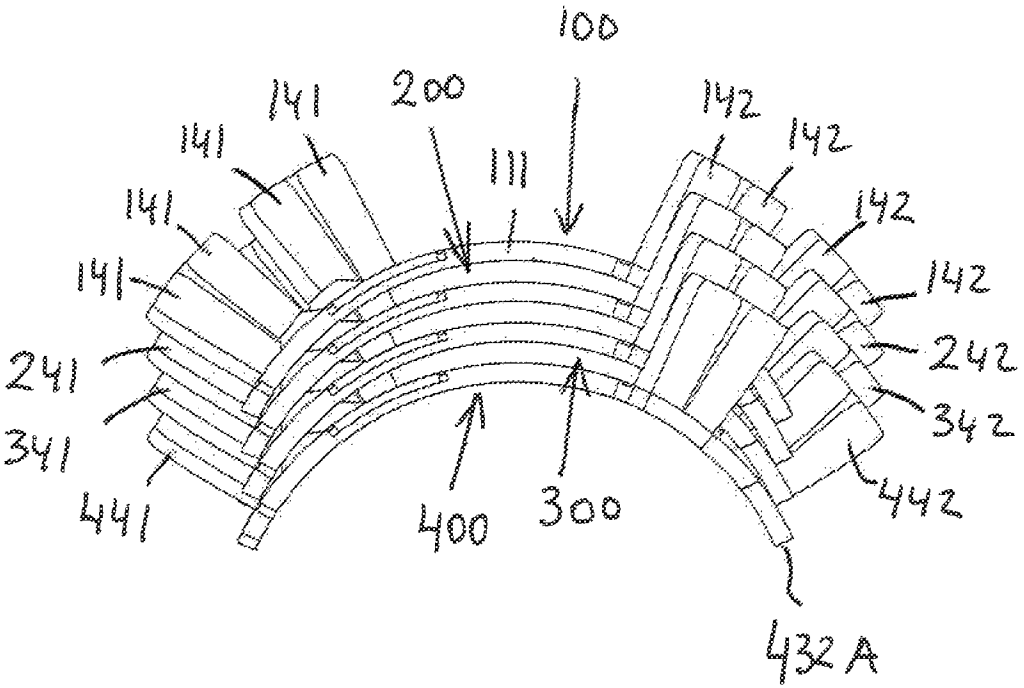

FIG. 7 shows four mutually stacked suppression elements, each of which being identical to the suppression element of FIG. 1, in the same orientation and in the same perspective view as in FIG. 3.

The reference signs used in the above-mentioned figures are referring to the above-mentioned parts and aspects of the invention, as well as to related parts and aspects, in the following manner

| | |
|---|---|
| 1 | tube |
| 7 | tensioning strap |
| 10 | tubular element |
| 11, 12 | tube segment |
| 100 | suppression element |
| 101 | inner side |
| 102 | outer side |
| 107 | tensioning strap groove |
| 111 | first end edge |
| 111A, 111B | positioning structure |
| 112 | second end edge |
| 112A, 112B | positioning structure |
| 121 | first fin longitudinal edge portion |
| 131, 131A, 131B | first non-fin longitudinal edge portion |
| 122 | second fin longitudinal edge portion |
| 132, 132A, 132B | second non-fin longitudinal edge portion |
| 141 | first fin structure |
| 142 | second fin structure |
| C | circumferential direction |
| L | longitudinal direction |
| R | reference axis |

Furthermore in FIGS. 4-7 the reference numerals 200, 300, 400, 500, 600 are referring to suppression elements which are identical to the suppression element 100. For these suppression elements 200, 300, 400, 500, 600 the parts which correspond with parts of the suppression element 100 are indicated by the same reference numerals, however, increased by the numbers 100, 200, 300, 400, 500, respectively. For example, in FIG. 4 the first fin structure 541 of the suppression element 500 corresponds to the first fin structure 141 of the suppression element 100.

Based on the above introductory description, including the brief description of the drawing figures, and based on the above explanation of the reference signs used in the drawing, the shown examples of FIGS. 1-7 are for the greatest part readily self-explanatory.

Figure 2:
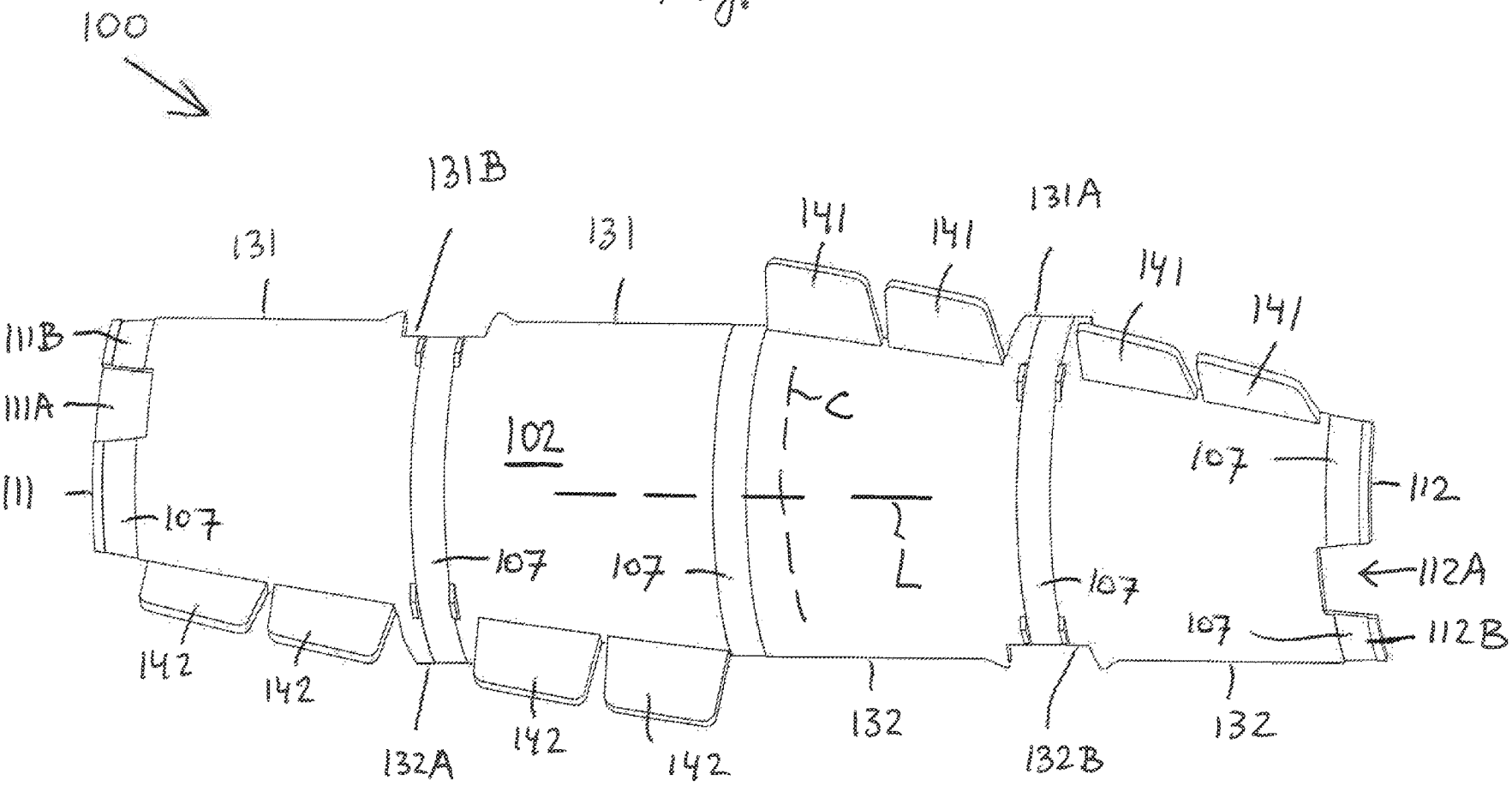
FIG. 2 shows a perspective view onto the outer side of the suppression element of FIG. 1.

FIGS. 1-3 show three different perspective views of the separate suppression element 100.

FIG. 4 shows a perspective view onto an assembly of the tubular element 10 and the tube 1 around the tubular element 10. The tube 1 is formed by mutually identical tube segments 11, 12 which in the longitudinal direction L are mutually interconnected. The tube segment 11 is formed by interconnection in the circumferential direction C of the three mutually identical suppression elements 100, 200, 300. The tube segment 12 is formed by interconnection in the circumferential direction C of the three mutually identical suppression elements 400, 500, 600.

The suppression elements 100, 200, 300, 400, 500, 600 of the tube 1 are held together by a number of tensioning straps 7. These tensioning straps 7 are mounted in tensioning strap grooves of the suppression elements. FIG. 2 shows the tensioning strap grooves 107 in the outer side of the suppression element 100.

FIG. 5 separately shows the suppression elements 100, 500 of the tube 1 of FIG. 4 which are mutually interconnected in the longitudinal direction L. Therein the suppression elements 100, 500, which are mutually adjacent in the longitudinal direction L, are mutually positioned in a staggered manner in the circumferential direction C. This is realized in that the suppression element 100 has the positioning structure 111A, 111B, 112A, 112B, also see FIGS. 1-2, and in that the suppression element 500 has the similar positioning structure 511A, 511B, 512A, 512B. In FIG. 2 it is seen that the positioning structure of the suppression element 100 comprises, nearby the first end edge 111, a first slide-in portion 111A and an insert portion 111B, wherein the first slide-in portion 111A has a smaller thickness than the insert portion 111B. In FIGS. 1-2 it is further seen that the positioning structure of the suppression element 100, nearby the second end edge 112, comprises a recess 112A and a second slide-in portion 112B.

In the situation of FIG. 5 the insert portion 511B of the suppression element 500 has been inserted into the recess 112A of the suppression element 500, and the first slide-in portion 511A of the suppression element 500 and the second slide-in portion 112B of the suppression element 100 have been slided over one another.

FIG. 6 separately shows the suppression elements 100, 200 of the tube 1 of FIG. 4 which are mutually interconnected in the circumferential direction C. In FIGS. 1-2 it is seen that the first longitudinal edge 121, 131, 131A, 131B of the suppression element 100 comprises the first fin longitudinal edge portions 121, as well as the first non-fin longitudinal edge portions 131, 131A, 131B. The first non-fin longitudinal edge portion 131A is, as seen in perpendicular projection relative to the longitudinal direction L, situated between respective first fin longitudinal edge portions 121 of the suppression element 100. In FIGS. 1-2 it is furthermore seen that the second longitudinal edge 122, 132, 132A, 132B of the suppression element 100 comprises the second fin longitudinal edge portions 122, as well as the second non-fin longitudinal edge portions 132, 132A, 132B. The second non-fin longitudinal edge portion 132A is, as seen in perpendicular projection relative to the longitudinal direction L, situated between respective second fin longitudinal edge portions 122 of the suppression element 100.

In the situation of FIG. 6 the second non-fin longitudinal edge portions 132A, 132B of the suppression element 100 are adjacent to the second non-fin longitudinal edge portions 231B, 231A of the suppression element 200, respectively.

In FIG. 4 it is seen that the second fin structure 342 of the suppression element 300, the first fin structure 141 of the suppression element 100, the second fin structure 442 of the suppression element 400, and the first fin structure 541 of the suppression element 500, respectively, are lying helically in-line relative to one another. In correspondence therewith also the second fin longitudinal edge portions of the suppression element 300, the first fin longitudinal edge portions of the suppression element 100, the second fin longitudinal edge portions of the suppression element 400, and the first fin longitudinal edge portions of the suppression element 500, respectively, are lying helically in-line relative to one another.

Likewise in FIG. 4 it is seen that the second fin structure 142 of the suppression element 100, the first fin structure 241 of the suppression element 200, the second fin structure 542 of the suppression element 500, and the first fin structure 641 of the suppression element 600, respectively, are lying helically in-line relative to one another. In correspondence therewith also the second fin longitudinal edge portions of the suppression element 100, the first fin longitudinal edge portions of the suppression element 200, the second fin longitudinal edge portions of the suppression element 500, and the first fin longitudinal edge portions of the suppression element 600, respectively, are lying helically in-line relative to one another.

Likewise in the situation of FIG. 4 the second fin structure 242 of the suppression element 200, the first fin structure (niet getoond) of the suppression element 300, the second fin structure (niet getoond) of the suppression element 600, and the first fin structure 441 of the suppression element 400, respectively, are lying helically in-line relative to one another. In correspondence therewith also the second fin longitudinal edge portions of the suppression element 200, the first fin longitudinal edge portions of the suppression element 300, the second fin longitudinal edge portions of the suppression element 600, and the first fin longitudinal edge portions of the suppression element 400, respectively, are lying helically in-line relative to one another.

FIG. 7 shows the four mutually identical suppression elements 100, 200, 300, 400 in a mutually stacked manner, and in the same orientation and in the same perspective view as in FIG. 3. It is seen that the suppression elements are compactly stackable. Thanks to the invention this compact stackability has been obtained despite the fact that the fins of the first and second fin structures 141 and 142 do not have corresponding shapes, since the fins are solid, non-nestable fins, just like for example the solid, non-nestable fins 7 in FIGS. 1-2 of U.S. Pat. No. 9,140,385B2. It is furthermore thanks to the invention that the compact stackability of the suppression elements is obtained while preserving the strong and reliable construction of the tubes formed by the suppression elements, and while preserving the effectivity in reducing vortex induced vibrations.

It is remarked that the above-mentioned examples of embodiments do not limit the invention, and that various alternatives are possible within the scope of the appended claims. It is furthermore remarked that parenthesized reference signs used in the claims are not to be construed as limiting features of a claim concerned.

For example various variations are possible in the shapes, dimensions and materials of a suppression element according to the invention. If, for example, a suppression element according to the invention comprises said positioning structure, then, instead of the shown combination of the first slide-in portion 111A, the insert portion 111B, the recess 112A and the second slide-in portion 112B, various other embodiments of a positioning structure of a suppression element according to the invention are possible.

A suitable material for manufacturing a suppression element according to the invention is for example a foamed plastic, and more in particular a polyethene (PE). Because of this, the element not only is lightweight, but it can also be manufactured from recycled plastic, which is environment-friendly. Another suitable material is polypropylene (PP). Such a material has good shape-retaining properties, also at high temperatures, and can for example be applied to pipings through which a fluid is transported under increased temperature.

These and similar alternatives are deemed to fall within the scope of the invention as defined in the appended claims.

The invention claimed is:

1. A suppression element for vortex vibrations, wherein:

the suppression element has a longitudinal direction, as well as a circumferential direction around a reference axis which is parallel to the longitudinal direction, and wherein the suppression element has an inner side and an opposite outer side, wherein the inner side has a concave shape in the circumferential direction and the outer side has a convex shape in the circumferential direction, and wherein the suppression element on both ends in the longitudinal direction has a first end edge and an opposite second end edge, and wherein the suppression element on both ends in the circumferential direction has a first longitudinal edge and an opposite second longitudinal edge;

the suppression element is configured for partly enveloping, in the circumferential direction, a tubular element, in such manner that the suppression element with the inner side is facing the tubular element for forming, in operation, a tube segment, which is extending co-axially round said reference axis, and which can co-axially envelope the tubular element all round as a result of a pre-determined number N of at least two specimens of the suppression element being mutually interconnected in the circumferential direction, so that, when N=2, said tube segment has one, and only one, pair of suppression elements which in said pair are adjacent to one another in the circumferential direction, and when N≥3, said tube segment has N, and only N, pairs of suppression elements which in each pair concerned are adjacent to one another in the circumferential direction;

said tube segment in the longitudinal direction has an overall length which is equal to the overall length of the suppression element in the longitudinal direction; and said tube segment is configured for forming, in operation, a tube around the tubular element as a result of multiple specimens of said tube segment being mutually interconnected in the longitudinal direction; and the suppression element comprises a fin structure, which on said outer side is protruding at least in radial direction relative to said reference axis, and which is configured for reducing, in operation, vorticity shedding at the downstream side of the tubular element;

wherein:

the first longitudinal edge comprises at least one first fin longitudinal edge portion, wherein the at least one first fin longitudinal edge portion is extending helically around said reference axis;

the fin structure comprises a first fin structure, which is extending along and from said at least one first fin longitudinal edge portion, and which on said outer side at said at least one first fin longitudinal edge portion is protruding from said at least one first fin longitudinal edge portion in said radial direction for said reducing of said vorticity shedding;

the second longitudinal edge comprises at least one second fin longitudinal edge portion, wherein the at least one second fin longitudinal edge portion is extending helically around said reference axis;

the fin structure comprises a second fin structure, which is extending along and from said at least one second fin longitudinal edge portion, and which on said outer side at said at least one second fin longitudinal edge portion is protruding from said at least one second fin longitudinal edge portion in said radial direction for said reducing of said vorticity shedding; and the at least one first fin longitudinal edge portion and the at least one second fin longitudinal edge portion of the suppression element are configured such that, for each pair concerned of said one pair of suppression elements or of said N pairs of suppression elements, the at least one first fin longitudinal edge portion of one suppression element of said pair concerned and the at least one second fin longitudinal edge portion of the other suppression element of said pair concerned are lying helically in line relative to one another.

2. The suppression element according to claim 1, wherein:

the first longitudinal edge comprises at least one first non-fin longitudinal edge portion, along which said first fin structure is not extending;

the second longitudinal edge comprises at least one second non-fin longitudinal edge portion, along which said second fin structure is not extending;

the at least one first non-fin longitudinal edge portion and the at least one second non-fin longitudinal edge portion of the suppression element are configured such that, for each pair concerned of said one pair of suppression elements or of said N pairs of suppression elements, the at least one first non-fin longitudinal edge portion of one suppression element of said pair concerned and the at least one second non-fin longitudinal edge portion of the other suppression element of said pair concerned are adjacent to one another.

3. The suppression element according to claim 2, wherein said being adjacent to one another of said at least one first non-fin longitudinal edge portion of one suppression element of said pair concerned and the at least one second non-fin longitudinal edge portion of the other suppression element of said pair concerned, as seen in perpendicular projection relative to the longitudinal direction, occurs at least between two respective first fin longitudinal edge portions of said one suppression element of said pair concerned.

4. The suppression element according to claim 2, wherein said being adjacent to one another of said at least one first non-fin longitudinal edge portion of one suppression element of said pair concerned and the at least one second non-fin longitudinal edge portion of the other suppression element of said pair concerned, as seen in perpendicular projection relative to the longitudinal direction, occurs at least between two respective second fin longitudinal edge portions of said other suppression element of said pair concerned.

5. The suppression element according to claim 1, wherein the suppression element comprises a positioning structure, which is configured for positioning of suppression elements of said tube, said suppression elements being adjacent to one another in the longitudinal direction, in fixed mutually staggered positions relative to one another in the circumferential direction, in such manner that, for each pair of tube segments which in said tube are adjacent to one another in the longitudinal direction, each time the at least one first fin longitudinal edge portions and the at least one second fin longitudinal edge portions of the suppression elements of one tube segment of such a pair of tube segments concerned are lying helically in line relative to first and second fin longitudinal edge portions of the other tube segment of said pair of tube segments concerned.

6. A stack comprising at least two mutually stacked suppression elements according to claim 1, wherein the stack comprises at least a first suppression element and a second suppression element, which are directly stacked relative to one another, and wherein the first suppression element with its inner side is facing the second suppression element, and wherein the second suppression element with its outer side is facing the first suppression element.

7. A tube segment comprising at least two suppression elements according to claim 1 in said pre-determined number N for forming the tube segment, wherein the at least two suppression elements have a common longitudinal direction and a common circumferential direction, and wherein the at least two suppression elements are mutually interconnected in the circumferential direction, and wherein the tube segment in the longitudinal direction has an overall length which is equal to the overall length of each suppression element in the longitudinal direction, and wherein said tube segment is configured for forming in operation a tube as a result of multiple specimens of said tube segment being interconnected to one another in the longitudinal direction.

8. A tube comprising at least two tube segments according to claim 7, wherein the at least two tube segments are interconnected to one another in the longitudinal direction.

* * * * *